US008596015B2

(12) United States Patent
Coon

(10) Patent No.: US 8,596,015 B2
(45) Date of Patent: Dec. 3, 2013

(54) ANTI-THEFT DEVICE

(76) Inventor: Stephen A. Coon, Windermere, FL (US)

( * ) Notice: Subject to any disclaimer, the term of this patent is extended or adjusted under 35 U.S.C. 154(b) by 0 days.

(21) Appl. No.: 12/418,397

(22) Filed: Apr. 3, 2009

(65) Prior Publication Data

US 2009/0249842 A1 Oct. 8, 2009

Related U.S. Application Data

(60) Provisional application No. 61/042,028, filed on Apr. 3, 2008.

(51) Int. Cl.
*E04G 25/00* (2006.01)
*E04H 12/18* (2006.01)

(52) U.S. Cl.
USPC ..... 52/632; 52/645; 52/646; 52/67; 52/653.2; 256/67; 248/354.1

(58) Field of Classification Search
USPC ..... 52/3, 23, 646, 36.1, 106, 632, 645, 52/656.1, 653.1, 653.2, 27, 74, 301, 126.6, 52/213; 135/95, 145, 138, 140, 118, 135/120.2, 139, 141, 156; 62/259.1, 428, 62/263; 160/201, 205, 206, 207, 214, 39, 160/80, 71, 372; 206/320, 321; 150/154, 150/157, 165; 165/134.1; 256/24–27, 32, 256/37, 73, 30, 31, 35, 1, 64, 67, 65.01, 256/65.02; 49/55; 248/354.1; 119/513, 506, 119/522; 182/2.11
See application file for complete search history.

(56) References Cited

U.S. PATENT DOCUMENTS

| | | | | | |
|---|---|---|---|---|---|
| 2,144,747 | A * | 1/1939 | Adams | 135/138 |
| 2,440,449 | A * | 4/1948 | Raemer | 52/82 |
| 2,771,896 | A * | 11/1956 | Call | 135/140 |
| 3,222,841 | A * | 12/1965 | Lipof | 52/482 |
| 3,494,405 | A * | 2/1970 | Bartelmas et al. | 160/24 |
| 4,077,418 | A * | 3/1978 | Cohen | 135/95 |
| 5,226,264 | A * | 7/1993 | Walters | 52/63 |
| 5,253,839 | A * | 10/1993 | McClure | 248/354.1 |
| 5,748,507 | A * | 5/1998 | Abatzoglou et al. | 702/76 |
| 6,089,247 | A * | 7/2000 | Price | 135/145 |
| 6,138,993 | A * | 10/2000 | Mitchell et al. | 256/25 |
| 6,430,954 | B1 * | 8/2002 | Smith | 62/259.1 |
| 6,595,017 | B1 * | 7/2003 | Teahan | 62/259.1 |
| 6,725,808 | B2 * | 4/2004 | Campbell et al. | 119/513 |

* cited by examiner

*Primary Examiner* — Chi Q Nguyen
(74) *Attorney, Agent, or Firm* — Terry M. Sanks, Esq.; Beusse Wolter Sanks Mora & Maire, P.A.

(57) ABSTRACT

An anti-theft device is provided comprising a frame comprising at least three interconnected sides. A plurality of interconnected frame members define the at least three interconnected sides of the device. A longitudinal extent or a vertical extent of one of the interconnected frame members is slidably movable within a bore of a longitudinal extent or a vertical extent of another of the interconnected frame members to a desired position, thereby allowing the device to be adjusted in one of a horizontal or vertical direction. The plurality of interconnected frame members define at least a rectangular-shaped region on each of the at least three interconnected sides.

19 Claims, 4 Drawing Sheets

ANTI-THEFT DEVICE

CROSS-REFERENCE TO RELATED APPLICATIONS

This application claims benefit under 35 U.S.C. 119(e)(1) of the Apr. 3, 2008 filing date of U.S. Provisional Application No. 61/042,028, the entirety of which is incorporated by reference herein.

FIELD OF THE INVENTION

The present invention relates to an anti-theft device, and more particularly to an adjustable anti-theft device for objects such as outdoor air condenser units.

BACKGROUND OF THE INVENTION

Air conditioners are well-known appliances, systems, or mechanisms designed to stabilize the air temperature and humidity within an area. Generally, air conditioners include a compressor, a condenser, and an evaporator. The typical central air conditioning system used in homes and in buildings is a split system comprising an outdoor unit (air condensing unit) and an indoor unit (air handler). The outdoor unit comprises a number of components, e.g., coils that are formed from recyclable materials, e.g., copper. As the interest in recyclable metal components has increased, there has been a corresponding increase in the theft of outdoor air condensers across the country. Commonly, thieves will disassemble the air condenser unit and will steal the valuable components therein or will simply detach connecting fluid or air lines and haul away the valuable air compressor unit. Accordingly, there is a need for an improved anti-theft device for objects such as outdoor air condensers.

SUMMARY OF THE INVENTION

In accordance with one aspect of the present invention, there is provided an anti-theft device. The device comprises a frame having at least three interconnected sides. In addition, the anti-theft device further comprises means for adjusting a height or a length of the at least three interconnected sides in at least one of a horizontal or vertical direction. A foot is provided extending downward from at least one of the at least three sides. The foot has a horizontal extent that includes an aperture. Further, the anti-theft device comprises an anchor comprising a vertical extent. The vertical extent is configured to extend upwardly through the aperture of the foot and also comprises an aperture for receiving a locking device to secure the frame in place.

In accordance with another aspect of the present invention, there is provided an anti-theft device comprising a frame having at least three interconnected sides. The at least three interconnected sides comprise a plurality of interconnected frame members. A longitudinal extent or a vertical extent of one of the interconnected frame members is slidably movable within a bore of a respective longitudinal extent or a vertical extent of another of the interconnected frame members to a desired position. The plurality of interconnected frame members define at least a rectangular-shaped region on each of the at least three interconnected sides. A foot is provided extending downward from at least one of the at least three sides. The foot has a horizontal extent that includes an aperture. Further, the anti-theft device comprises an anchor comprising a vertical extent. The vertical extent is configured to extend upwardly through the aperture of the foot and also comprises an aperture for receiving a locking device to secure the frame in place.

In accordance with yet another aspect of the present invention, there is provided in combination, an air condenser unit and an anti-theft device for erection around a perimeter of the air conditioner unit. The anti-theft device comprises a frame having at least three interconnected sides. The at least three interconnected sides each comprise a plurality of interconnected frame members. A longitudinal extent or a vertical extent of one of the interconnected frame members is slidably movable within a bore of a respective longitudinal extent or a vertical extent of another of the interconnected frame members to a desired position. In addition, the plurality of interconnected frame members define at least a rectangular-shaped region on each of the at least three interconnected sides. Further, a foot is provided extending from at least one of the at least three sides. The foot has a horizontal extent that includes an aperture. Even further, the anti-theft device comprises an anchor comprising a vertical extent. The vertical extent is configured to extend upwardly through the aperture of the foot and comprises an aperture for receiving a locking device to secure the frame in place.

DETAILED DESCRIPTION OF THE INVENTION

The present inventor has developed an anti-theft device, which once erected and installed, fully prevents access to an object encompassed by the anti-theft device. For example, when erected around the walls of an air condenser unit, the anti-theft device fully prevents access to the side panels of the air condenser unit and further prevents thieves from disconnecting any lines and carrying the air condenser unit away. Advantageously, the frame is constructed in such a way as to form a rigid fence-like structure that is strongly secured to a ground to prevent any dismantling of the anti-theft device. Further advantageously, the anti-theft device is configured to be easily adjustable such that the anti-theft device can be optimally fit around the object to be protected. Moreover, the length, height, and depth of the anti-theft device can be adjusted to fit about the perimeter of various sized objects, such as various sized air condenser units, or may be adjusted to fit around multiple air condenser units, for example. This eliminates the need for manufacturers to carry a multitude of devices for the different sized units, thereby eliminating costs and inventory needs for manufacturers and sellers of such devices. Further, this eliminates the need for the buyer to buy multiple devices to protect multiple air condenser units, for example.

Figure 1:
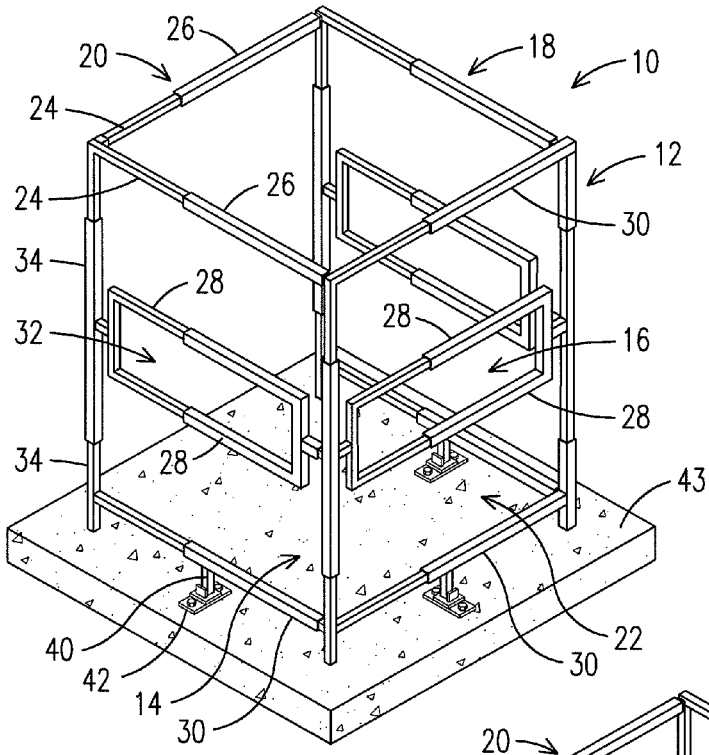
FIG. 1 is a perspective view of an anti-theft device in accordance with an aspect of the present invention.

Referring now to the drawings, FIG. 1 shows an embodiment of the anti-theft device 10 (device 10) in accordance with an aspect of the present invention. As shown, the device 10 comprises a frame 12 comprising a first side 14, a second side 16, a third side 18, and a fourth side 20 defining a cavity 22 therebetween. At least three of the sides 14-20 include interconnecting frame members 24. In the embodiment shown, interconnecting frame members 24 of sides 14, 16, and 18 comprise upper horizontal frame members 26, middle horizontal frame members 28, and lower horizontal frame members 30, each of which extend longitudinally or horizontally across a respective side (14, 16, 18) of the frame 12. Each of the middle horizontal frame members 28 includes a rectangular-shaped region 32 that aids in preventing access to the cavity 22 from an exterior of the frame 12. The rectangular-shaped region 32 is not only aesthetically more pleasing than a cross-bar configuration, but also structurally enables the frame to be shortened and elongated quickly while maintaining its shape as its configuration is adjusted.

Although a rectangular-shaped region 32 is shown and preferred, the middle horizontal frame members 28 may define another shape so long as a length of the middle horizontal frame members 28 is capable of being shortened and lengthened as desired. In the embodiment shown, side 20 comprises a single upper horizontal frame member 26 to stabilize the frame 12 and interconnect sides 14 and 18. It is appreciated that less or further horizontal frame members (e.g., 26, 28, and 30) may be utilized depending on the size of the frame needed and the particular application for the device. Typically, the frame 12 (and its components) is constructed from a relatively rigid material, such as aluminum, stainless steel, e.g., 16 gage stainless steel, and the like.

Figure 4:
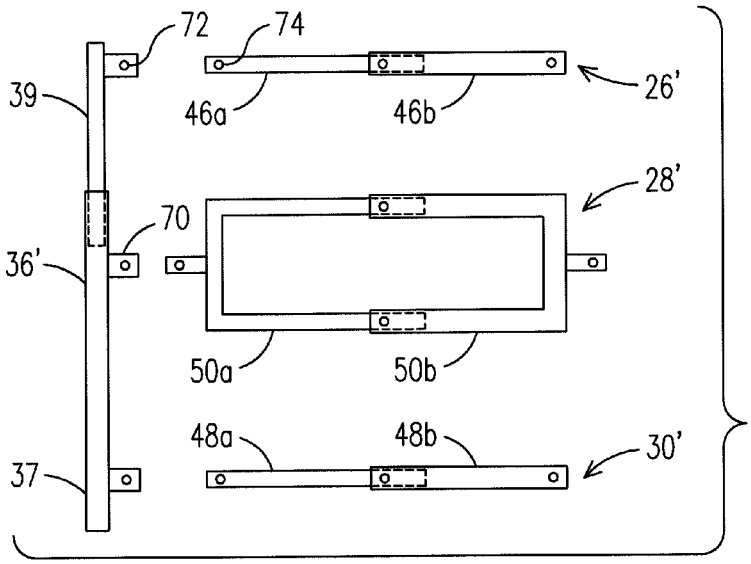
FIG. 4 is a perspective view of a vertical post and adjacent interconnecting frame members in accordance with an aspect of the present invention.

In one embodiment, a plurality of the upper horizontal frame members 26, middle horizontal frame members 28, and lower horizontal frame members 30 also include a vertical extent 34, which may be interconnected with a respective adjacent vertical extent 34 of another horizontal frame member 26, 28, 30 to form a vertical post 36 at each of the four corners 38 of the frame 12. The vertical post 36 extends from a top to a bottom of the frame 12. Alternatively, as shown in FIG. 4, horizontal frame members 26', 28', 30' have no vertical extents. Instead, four distinct vertical posts 36' may be provided at each of the four corners 38 of the frame 12. Each of the vertical posts 36' is adjustable in height as described herein. For example, a portion 37 of one vertical post 36' (at each corner 36) that is not a portion of a horizontal frame members 26', 28', and 30' may be slidably movable within another portion 39 of the vertical post 36' to adjust a height of the frame 12 at the corners 38 of the frame 12. Each of the vertical posts 36 is securable to the frame members 24 via any suitable fastening device, e.g., nuts and bolts by aligning an aperture 74 on members 26', 28', and 30' with an aperture 72 of tabs 70 and inserting the bolt therethrough. Any frame members described herein may be interconnected via such a configuration, or alternatively via any other suitable structure, e.g., mating threaded portions with accept a threaded screw.

Referring again to FIG. 1, when the frame 12 is erected around an object as set forth below, access to the objected is thereby prevented. To secure the frame 12 to the ground, the frame 12 may comprise a foot 40 associated with one of the horizontal frame members 26, 28, 30, typically one of the lower horizontal frame members 30 on at least one of the sides 14-20 of the frame 12. The foot 40 is adapted to mate with an anchor 42, which may be secured to the ground 43 or to another fixed object to secure the frame 12 in place.

Figure 2:
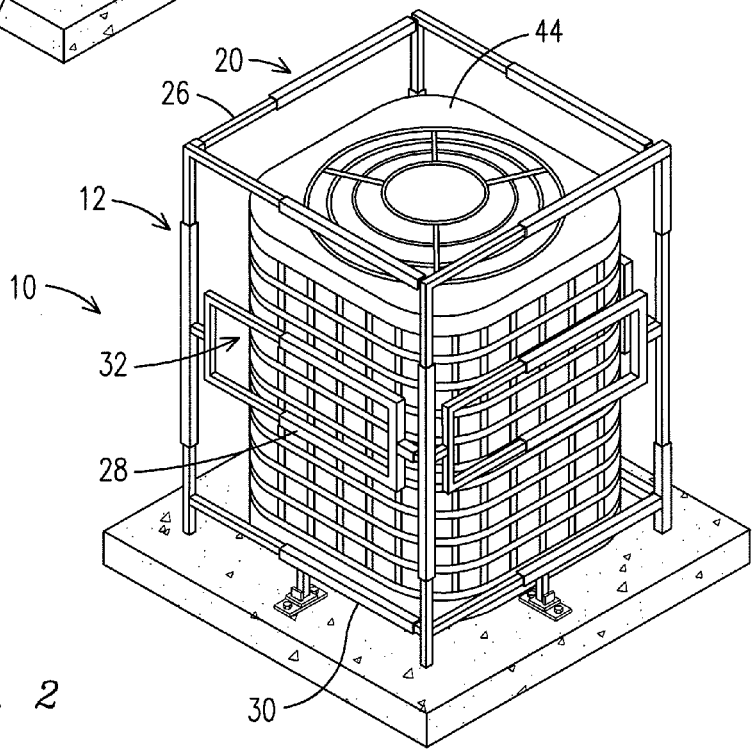
FIG. 2 is a perspective view of an anti-theft device installed about the perimeter of an outdoor air condenser unit in accordance with an aspect of the present invention.

In the case of an outdoor air condenser unit, e.g., unit 44, the device 10 may be erected around the perimeter of the air condenser unit 44 to prevent access to the side panels of an air condenser unit. It is understood that when the object to be protected by the device 10 is near a wall, the frame 12 need only have three sides with interconnecting horizontal frame members 26-30. Optionally, however, all four sides 14-20 may be provided with interconnecting horizontal frame members 26-30 as described herein. As shown in FIG. 2, an exemplary air condenser 44 is shown as being protected by a fully-assembled device 10 in accordance with the present invention. Three sides (e.g., 14, 16, 18) of the device 10 prevent the side panels of the air condenser 44 from being removed, and thus entry into the air condenser 44 to remove its contents, e.g., valuable copper components. In addition, the device 10 prevents the air condenser unit 44 encompassed by the frame 12 from being carried away. If the frame 12 comprises three sides with a rectangular-shaped region 32 as shown, it is contemplated that the fourth side would typically be protected by a wall of the side of a house or building, other natural or man-made barrier, or the like. In one embodiment, the side 20 has an upper horizontal frame member 26 extending longitudinally across the side 20 to further stabilize the frame 12.

Advantageously, the height, width and depth of the frame 12 may be adjusted by adjusting the interconnecting frame members 24 in an up, down, left, or right direction to protect one or more air condenser units (or like objects) of greatly varying sizes from vandalism or theft. For example, the frame 12 may be adjusted from a configuration that snugly encompasses one air condenser unit to a configuration that encompasses two air condenser units, as well as adjusting for the size of the unit. Further advantageously, the height, width and depth of the frame 12 may be adjusted around gutters, cables, wires, or the like if necessary and to provide the desired spatial orientation around the air condenser unit 44. The embodiment below describes one construction for achieving the adjustability of the height, width, and depth of the frame 12 to fit about different sized objects, although it is understood that the present invention is not so limited.

FIG. 4 shows an embodiment of the anti-theft device 10 in an unassembled state. As shown, the device 10 comprises a frame 12 comprising upper horizontal frame members 26, middle horizontal frame members 28, and lower horizontal frame members 30 (defined as interconnecting frame members 24 above). Upper horizontal frame members 26, middle horizontal frame members 28, and lower horizontal frame members 30 form sides 14,16,18, and 20 of the device 10. In the embodiment shown, upper frame members 26 comprise opposed frame members 46*a*, 46*b*. A longitudinal extent 45 of one of the frame members 46*a* is slidably movable within a respective other one of the opposed frame members (e.g., frame member 46*b*) at a distal end 48 thereof. For example, opposed frame member 46*a* may have an outer diameter, e.g., ⅞ inch, which is adapted to be slidably movable within a bore 47 of the opposed frame member 46*b* such that the combined length of the opposed frame members 46*a*, 46*b* may be adjusted (increased or decreased) as desired. Optionally, the opposed frame members 46*a*, 46*b* may be further held in place together via a set screw 49 when the desired length is reached.

In the same way, lower horizontal frame members 30 comprise opposed frame members 48*a*, 48*b*, which may be similarly constructed, interconnected and adjusted in length in the same manner as opposed frame members 46*a*, 46*b*. The length of the opposed frame members 46*a*, 46*b*, 48*a*, 48*b* is such that the length of the upper frame members 26 and lower frame members 30 may be adjusted to various lengths. It is understood that the above embodiment is merely exemplary and any other suitable structure that provides stability and strength to the device while maintaining the adjustability of the length of the upper horizontal frame members 26, middle horizontal frame members 28, and lower horizontal frame members 30 may be utilized. Further, the adjustability of the frame in height or width may be realized by other configurations, such as another telescoping configuration, a ratcheting configuration that allows the incremental decrease or increase in length of any side and its members, or any other suitable configuration.

Referring again to FIG. 4, middle horizontal frame members 28 comprise opposed frame members 50*a*, 50*b*, each having a U-shaped portion 51 having longitudinal extents 55. The distal ends 54 of the longitudinal extents 55 of one opposed frame member, e.g., opposed frame member 50*a*, are interconnectable with the distal ends 54 of the longitudinal extents 55 of an opposed frame member, e.g., opposed frame member 50*b*. For example, longitudinal extents 55 of the distal ends 54 of the U-shaped portion 51 of opposed frame member 50*a* may have outer diameters, e.g., ⅞ inch, such that the distal ends 54 of one of the frame members (frame members 50*a*) are adapted to fit within a bore 57 of the distal ends 54 of the other of the opposed frame members (frame members 50*b*). In this way, one of the opposed frame members 50*a*, 50*b* is slidably movable within the other of the opposed frame members 50*a*, 50*b* to adjust a total length of the middle horizontal frame members 28, including the rectangular-shaped region 32, as desired. Optionally, the opposed frame members 50*a*, 50*b* may be further held in their desired position relative to one another via a set screw 49 or other suitable device.

Once interconnected, frame members 50*a*, 50*b* define the rectangular-shaped region 32 as shown in FIG. 1. In this way further, when the frame 12 is erected around an air condenser unit 44 as was shown in FIG. 2, the device 10 substantially prevents access to the contents of the air condenser unit 44. Further, when the frame members 46*a*46*b*, 48*a*, 48*b*, and 50*a*, 50*b* of each side are interconnected as described above, the frame members 46*a*, 46*b*, 48*a*, 48*b*, and 50*a*, 50*b* define respective sides 14, 16, and 18 of the device 10.

Figure 3:
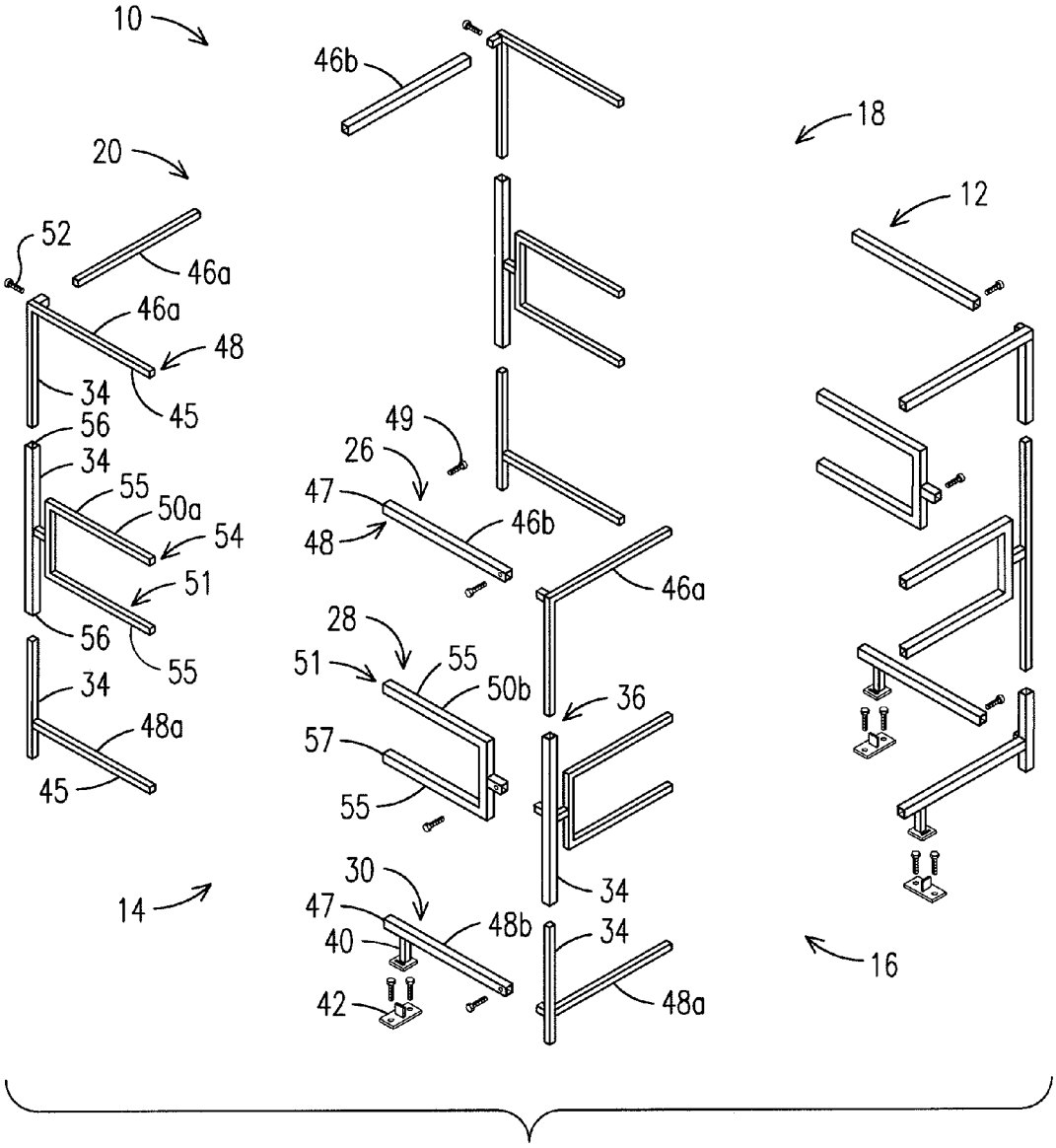
FIG. 3 is an exploded view of an unassembled anti-theft device in accordance with an aspect of the present invention.

To provide the vertical posts 36 at each corner 38 of the frame 12, a suitable number of the frame members 46*a*, 46*b*, 48*a*48*b*, 50*a*, 50*b* of each side (14-20) of the device 10 comprise a vertical extent 34. As will be appreciated by reference to FIG. 3 and by one skilled in the art, not all of the frame members 46*a*,46*b*, 48*a*,48*b*, 50*a*,50*b* need have a vertical extent 34. For example, as shown, frame members 46*a*, 48*a*, and 50*a*, of the right side 18 of the device may be interconnected with one another, such as by inserting a distal end 54 of one vertical extent 34 within a bore 56 of an adjacent vertical extent 34. Alternatively, any suitable method or structure may be used to secure adjacent vertical extents and frame members together. It is understood that the length of the vertical extents is such that the height of the vertical posts 36 at each corner 38 of the frame 12 may be adjusted as desired. In the embodiment shown, any side 14-20 of the frame 12 may be adjusted in height by varying the degree to which a vertical extent 34 of any one of frame members 46*a*,46*b*, 48*a*,48*b*, 50*a*,50*b* is disposed within a bore, e.g. bore 56, of an adjacent vertical extent 34 of another one of frame members 46*a*,46*b*, 48*a*,48*b*, 50*a*,50*b*. Once the vertical extent 34 of a frame member, e.g., frame member 46*a*, is disposed within an opposed frame member, e.g., frame member 50*a*, to a desired degree, the position of the vertical extents 34 may be fixed in position by a set screw 49 or the like. Further, it is understood that the above embodiment is merely exemplary and any other suitable structure that provides stability and strength to the frame 12 while maintaining the adjustability of the height of the vertical posts 36 may be utilized.

As needed, adjacent upper horizontal frame members 26, middle horizontal frame members 28, and lower horizontal frame members 30 may be further interconnected via any suitable structure to one another, to vertical posts, or to vertical extents 34 to build the frame. In one embodiment, adjacent horizontal frame members 26, 28, 30 are interconnected via mating threaded apertures in the horizontal frame members and screws 52 insertable into the mating apertures. For example, frame member 46*a* of side 18 and frame member 46*a* of side 20 may be interconnected by inserting a threaded screw 52 through mating threaded apertures of the frame member 46*a* of side 18 and the frame member 46*a* of side 20. Similarly, the other adjacent frame members as described herein may be fixedly secured to one another about the frame 12 to form a fully assembled frame 12 so long as the adjustability of the frame 12 in height and width is maintained for each of the sides 14-20, such as via inserting a bolt through mating apertures on any two adjacent frame members described and fastening with a nut.

Figure 5:
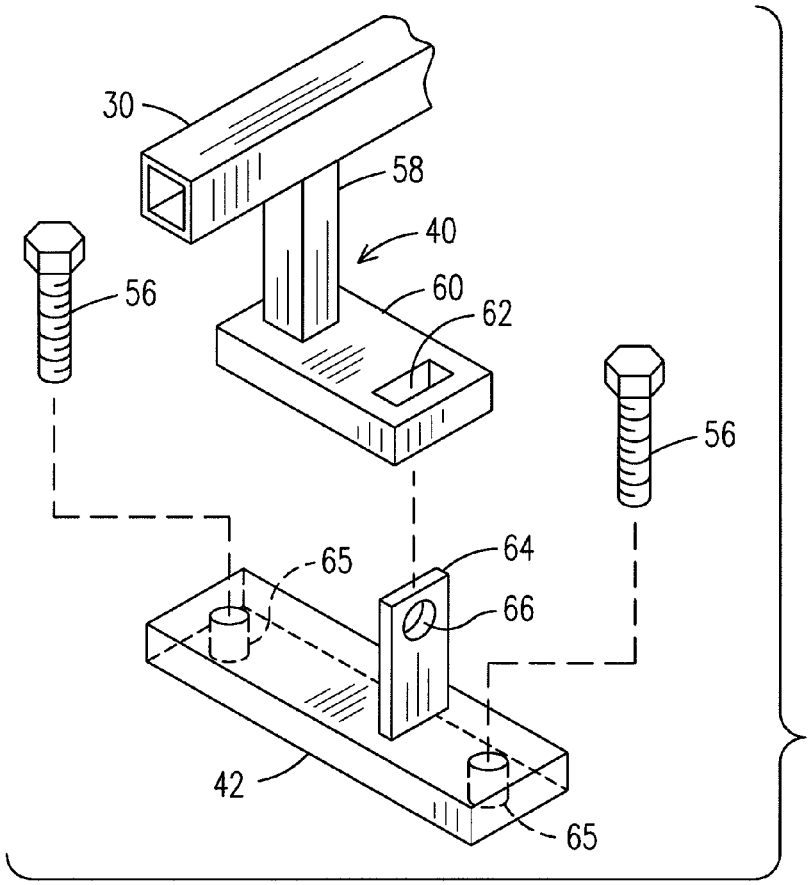
FIG. 5 is a perspective view of a foot and anchor in accordance with an aspect of the present invention.
Figure 6:
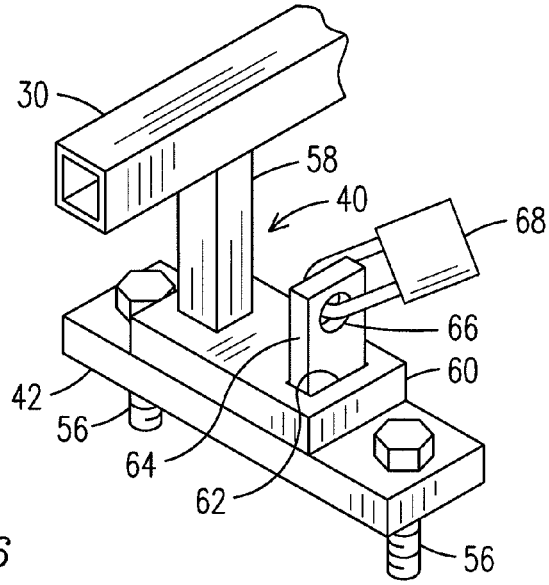
FIG. 6 is a perspective view of the foot and anchor of FIG. 5 device in an assembled state in accordance with an aspect of the present invention.

To securely maintain the device 10 around an existing air condenser to prevent tampering and theft of the object within the cavity 22 of the device 10, the frame 12 is preferably secured to a ground surface 43, e.g., cement, by suitable fastening devices. In one embodiment, as mentioned above and as shown in FIGS. 1 and 5, there is provided a foot 40, permanently or removably associated with one of the horizontal frame members 26, 28, or 30, typically disposed on and extending downward from one of the lower horizontal frame members 30 on at least one of the sides 14-20 of the device 10. As shown, the foot 40 is adapted to mate with an anchor 42, which may be secured to the ground 43 or to other fixed object to secure the frame 12 in place. In one embodiment, the anchor 42 is securable to a ground surface via bolts 56 as shown, which are insertable through apertures 65 in the anchor 42. The foot 40 has a vertical extent 58 and a horizontal extent 60 having an aperture 62. When the ground surface is cement, the cement may be poured over the bolts 56 (and optionally any portion of the anchor 42) or the bolts may otherwise be inserted into cement before drying. The anchor 42 has a vertical extent 64 that extends upward and is insertable through the aperture 62 of the foot 40. In addition, the vertical extent 64 of the anchor 42 includes an aperture 66 such that when the foot 40 is placed over the anchor 42 as shown in FIG. 6, a locking mechanism 68 may be placed within the aperture 66 of the anchor 42 to secure the frame 12 to the ground 43. Optionally, the device 10 may be modified to include a locking mechanism at any position of the frame 12 to further prevent any disassembly of the frame 12 without consent. For example, a locking mechanism may be provided to secure opposed frame members 46*a*, 46*b* in fixed relationship to one another.

Figure 7:
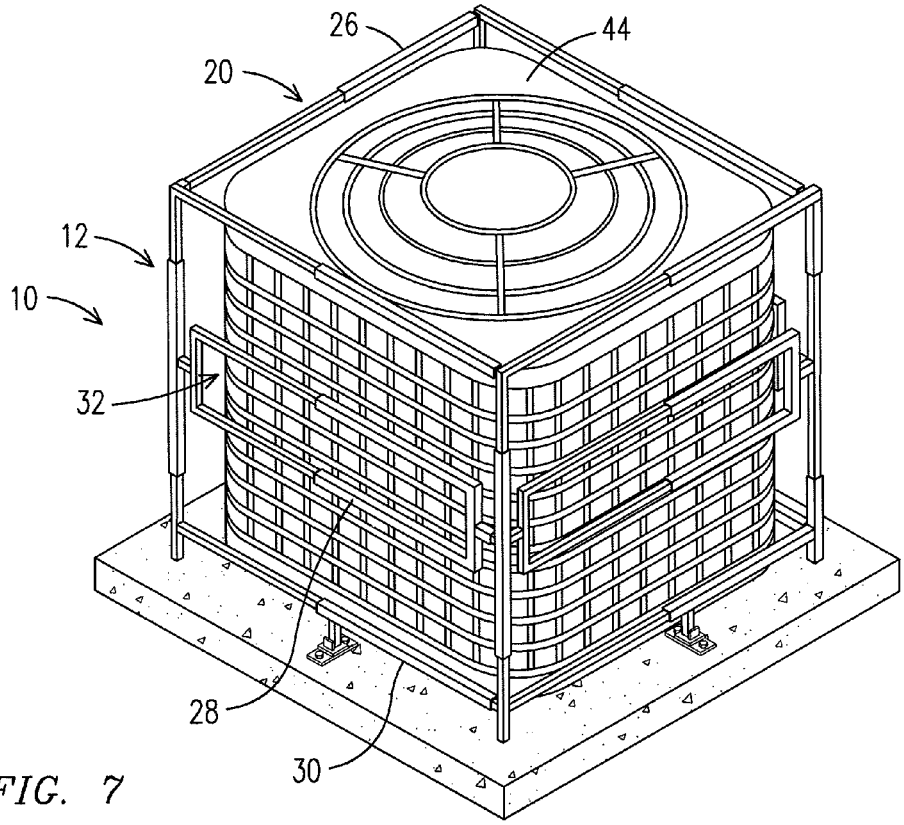
FIG. 7 is a perspective view of the view of the anti-theft device adjusted to accommodate an even larger sized air condenser unit relative to the air condenser unit shown in FIG. 2 in accordance with an aspect of the present invention.

Once erected and fully installed, the device 10 prevents access to the side panels of an object, such as the air condenser unit 44 placed within the cavity 22 as shown in FIG. 2. As a result, the device 10 prevents the side panels of the air condenser unit 44 from being removed, and thus prevents entry into the air condenser unit 44 to remove its contents. Moreover, the entire air condenser unit 42 is unable to be removed and carried away. As mentioned above, the height, length, width and depth of the frame 12 can be adjusted in any one or more of an up, down, left, or right direction to move around gutters, cables, wires, or the like, or to accommodate multiple, larger or smaller sized objects, e.g., air condenser units. As shown in FIG. 7, each of the sides 14, 16, 18, and 20 has been increased in size and depth to accommodate an even larger air condenser unit 44 and to provide the desired spatial orientation of the frame 12 about the unit. In an additional embodiment, the rectangular-shaped portion 32 or all or any portion of sides 14, 16, 18, or 20 may be covered with a screen or other mesh material to further prevent access to the object encompassed by the frame 12.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

I claim:

1. An anti-theft device comprising:

a frame comprising at least three interconnected sides, wherein the three sides define a cavity configured to contain an air conditioner unit;

each interconnected side comprising a plurality of interconnected frame members with one of the interconnected frame members comprising a middle horizontal frame member; and wherein said middle horizontal frame member is a geometric shaped region;

a first means for adjusting a length of the interconnected frame members of at least one side of the at least three interconnected sides and a second means for adjusting a vertical distance between the interconnected frame members of at least one side of the at least three interconnected sides, wherein the second means for adjusting the vertical distance is configured to adjust the middle horizontal frame member of the interconnected frame members in a vertical direction independent of the other interconnected frame members located above or below the middle horizontal frame member of a same interconnected side, such that the interconnected frame members of each side are spaced to prevent the air conditioner unit from being passed through the frame members of each side;

a foot extending downward from at least one of the at least three sides; and an anchor configured to extend upwardly to the foot for receiving a locking device to secure the frame in place.

2. The system of claim 1, wherein each of the interconnected frame members further comprise a lower horizontal frame member and an upper horizontal frame member, and wherein a longitudinal extent of one of the lower horizontal frame members, middle horizontal frame members, or upper horizontal frame members is slidably movable within a bore of a respective one of another of the lower horizontal frame members, middle horizontal frame members, or upper horizontal frame members to adjust a longitudinal length of the interconnected frame members.

3. The system of claim 1, wherein a plurality of the lower horizontal frame members, middle horizontal frame members, and upper horizontal frame members comprise interconnectable vertical extents defining vertical posts of the frame.

4. The system of claim 3, wherein one of the interconnectable vertical extents is slidably movable within a bore of an adjacent vertical extent such that a height of the device is adjustable.

5. The system of claim 1, wherein each of the at least three interconnected sides comprises a rectangular-shaped region that extends longitudinally along a substantial portion of the longitudinal length of each of the at least three sides.

6. The system of claim 5, wherein the rectangular-shaped region is defined by opposed middle horizontal frame members, and wherein distal ends of one of the opposed middle horizontal frame members are slidably movable within bores of adjacent ones of another one of the opposed middle horizontal frame members to adjust a length of the rectangular-shaped region.

7. The anti-theft device of claim 1, wherein the middle horizontal frame member comprises a geometric shape region which aids in preventing access to the cavity within the frame.

8. An anti-theft device for an air conditioning unit comprising:

a frame comprising at least three interconnected sides, wherein the at least three interconnected sides define a cavity within which the air conditioner unit is positioned, wherein the three interconnected sides comprise a plurality of interconnected frame members which define an upper horizontal frame member, a middle horizontal frame member; wherein said middle horizontal frame member is a rectangular shaped region, and a lower horizontal frame member, wherein a longitudinal extent and a vertical extent of one of the interconnected frame members is slidably movable relative to a respective longitudinal extent and a vertical extent of another of the interconnected frame members to a desired position, wherein the vertical extent of the middle horizontal frame member which is slidably movable relative to the respective vertical extent of another of the interconnected frame members provides for the middle horizontal frame member to be slidably movable in a vertical direction independent of the other interconnected frame members, wherein the plurality of interconnected frame members define at least a rectangular-shaped region on each of the at least three interconnected sides, and wherein the interconnected frame members of each side are spaced to prevent the air conditioner unit from being passed through the at least three interconnected sides;

a foot extending downward from at least one of the three sides, the foot having a longitudinal extent having a first aperture; and an anchor comprising a vertical extent, wherein the vertical extent is configured to extend upwardly through the aperture of the foot and wherein the vertical extent comprises a second aperture for receiving a locking device to secure the frame in place.

9. The system of claim 8, wherein the rectangular-shaped region is defined by opposed middle horizontal frame members, and wherein distal ends of one of the opposed middle horizontal frame members are slidably movable within bores of adjacent ones of another one of the opposed middle horizontal frame members to adjust a length of the rectangular-shaped region.

10. The system of claim 8, wherein the interconnected frame members comprise lower horizontal frame members and upper horizontal frame members, and wherein a longitudinal extent of one of the lower horizontal frame members, middle horizontal frame members, or upper horizontal frame members is slidably movable within a bore of a respective one of another of the lower horizontal frame members, middle horizontal frame members, or upper horizontal frame members to adjust a longitudinal length of the interconnected frame members.

11. The system of claim 10, wherein a plurality of the lower horizontal frame members, middle horizontal frame members, and upper horizontal frame members comprise interconnectable vertical extents defining vertical posts for the device.

12. The system of claim 11, wherein one of the interconnectable vertical extents is slidably movable within a bore of an adjacent vertical extent such that a height of the device is adjustable.

13. The anti-theft device of claim 8, wherein the middle horizontal frame member comprises a geometric shape region which aids in preventing access to the cavity within the frame.

14. In combination, an air conditioner unit and an anti-theft device for erection around a perimeter of the air conditioner unit, the combination comprising:

an air conditioner unit defined by a housing having components carried therein;

a frame comprising at least three interconnected sides configured to extend around at least three sides of the air conditioner unit, wherein the at least three interconnected sides comprise a plurality of interconnected frame members configured to prevent access to the air conditioned unit, wherein one of the interconnected frame members comprises a middle horizontal frame member; wherein said middle horizontal frame member is a rectangular shaped region, wherein a longitudinal extent and a vertical extent of one of the interconnected frame members is slidably movable relative to a respective longitudinal extent and a vertical extent of another of the interconnected frame members to a desired position, wherein the vertical extent of the middle horizontal frame member which is slidably movable relative to the respective vertical extent of another of the interconnected frame members provides for the middle horizontal frame member to be slidably movable in a vertical direction independent of the other interconnected frame members; and wherein the plurality of interconnected frame members define at least a rectangular-shaped region on each of the at least three interconnected sides;

a foot extending downward from at least one of the at least three sides, the foot having a horizontal extent having a first aperture; and an anchor comprising a vertical extent, wherein the vertical extent is configured to extend upwardly through the aperture of the foot, and wherein the vertical extent comprises a second aperture for receiving a locking device to secure the frame in place.

15. The combination of claim 14, wherein the rectangular-shaped region extends longitudinally along a substantial portion of the longitudinal length of each of the at least three sides, and, wherein the rectangular-shaped region is defined by opposing middle horizontal frame members, and wherein distal ends of one of the opposing middle horizontal frame members are slidably movable within bores of adjacent ones of another one of the opposing middle horizontal frame members to adjust a length of the rectangular-shaped region.

16. The combination of claim 14, wherein the interconnected frame members comprise lower horizontal frame members and upper horizontal frame members, and wherein a longitudinal extent of one of the lower horizontal frame members, middle horizontal frame members, or upper horizontal frame members is slidably movable within a bore of a respective one of another of the lower horizontal frame members, middle horizontal frame members, or upper horizontal frame members to adjust a longitudinal length of the interconnected frame members.

17. The combination of claim 14, wherein a plurality of the lower horizontal frame members, middle horizontal frame members, and upper horizontal frame members comprise interconnectable vertical extents defining vertical posts for the device.

18. The combination of claim 14, wherein one of the interconnectable vertical extents is slidably movable within a bore of an adjacent vertical extent such that a height of the device is adjustable.

19. The combination of claim 14, wherein the middle horizontal frame member comprises a geometric shape region which aids in preventing access to a cavity within the frame.

* * * * *